US006305742B1

(12) United States Patent
Spendlove et al.

(10) Patent No.: US 6,305,742 B1
(45) Date of Patent: Oct. 23, 2001

(54) FOLDING MECHANISM FOR FOLDING CHAIR

(75) Inventors: Dale Spendlove; L. E. Tom Atkins, both of Orem, UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 09/425,580

(22) Filed: Oct. 22, 1999

(51) Int. Cl.[7] ..... A47C 4/00
(52) U.S. Cl. ..... 297/16.1; 297/55
(58) Field of Search ..... 297/55, 56, 57, 297/16.1

(56) References Cited

U.S. PATENT DOCUMENTS

| | | | | |
|---|---|---|---|---|
| 128,767 | | 7/1872 | Viele . | |
| 169,748 | | 11/1875 | Wakefield . | |
| 198,421 | | 12/1877 | Smith . | |
| 473,704 | | 4/1892 | Le Count . | |
| 779,327 | | 1/1905 | Stiggleman . | |
| 945,032 | | 1/1910 | Gillespie . | |
| 976,786 | | 11/1910 | Moulin . | |
| 1,591,550 | | 7/1926 | Rosenthal . | |
| 1,815,643 | * | 7/1931 | Allerding | 297/55 |
| 1,838,213 | * | 12/1931 | Buffington | 297/55 |
| 1,900,486 | * | 3/1933 | Clarin | 297/56 |
| 1,975,622 | | 10/1934 | Schermerhorn . | |
| 2,262,500 | * | 11/1941 | Johannsen | 297/55 |
| 2,303,189 | * | 11/1942 | Adler | 297/55 |
| 2,514,125 | | 7/1950 | Evans . | |
| 2,568,269 | | 9/1951 | Burnham et al. . | |
| 2,874,755 | | 2/1959 | Smith . | |
| 2,982,339 | * | 5/1961 | Clarin | 297/56 |
| 3,087,755 | | 4/1963 | Boman . | |
| 3,220,764 | | 11/1965 | Duer . | |
| 3,639,001 | | 2/1972 | Anderson . | |
| 3,669,496 | | 6/1972 | Chisholm . | |
| 4,235,473 | | 11/1980 | Aginar . | |
| 4,319,779 | | 3/1982 | Leonhart . | |
| 5,040,848 | | 8/1991 | Irie et al. . | |
| 5,071,191 | | 12/1991 | Leib . | |
| 5,096,259 | | 3/1992 | Stanfield . | |
| 5,383,712 | | 1/1995 | Perry . | |
| 5,825,095 | | 10/1998 | Albecker, III . | |

* cited by examiner

*Primary Examiner*—Peter M. Cuomo
*Assistant Examiner*—Stephen Vu
(74) *Attorney, Agent, or Firm*—Thorpe North & Western

(57) ABSTRACT

A folding chair has a support frame with a back support portion and first and second side supports extending to form front leg members. A seat is pivotally coupled to the support frame, and configured to pivot downwardly with respect to the support frame. First and second rear legs each have an upper member pivotally coupled to a lower member. The lower members are pivotally coupled to the support frame, and the upper members are pivotally coupled to the seat, such that the first and second rear legs include three pivot points and the rear legs fold onto themselves to a shorter length in a closed position. First and second folding systems link the support frame, the fold-down seat, and the rear legs together. The first and second folding systems including four-bar linkage systems with four pivot points and four linkages. At least one stopping member is coupled to the four-bar linkage system shaped and positioned to engage at least one of the linkages of the folding system in an opened unfolded position to provide a limited opened position.

27 Claims, 7 Drawing Sheets

FOLDING MECHANISM FOR FOLDING CHAIR

BACKGROUND OF THE INVENTION

1. The Field of the Invention

The present invention relates generally to a folding chair, and/or a stackable/storable folding chair system. More particularly, the present invention relates to a folding chair having a folding mechanism which collapses or folds upon itself to save space, and a safe stopper member for limiting movement of the folding mechanism in the open position to provide a limited opened position, and to resist pinching.

2. The Background Art

Folding chairs are often used in situations in which it is desirable or necessary to provide varying numbers and/or varying layouts of chairs, such as during conventions, seminars, conferences, etc. In addition, folding chairs are often used in multipurpose areas in which patron seating is required for some functions, but a large open space is required for other functions necessitating storage of the chairs. For example, some organizations have buildings with a multipurpose room which may be used for banquets, seminars, conventions, etc., with chairs set up, or for a dance, sporting event, etc., with the folding chairs removed.

It is desirable that the folding chairs be capable of being folded and stacked for storage so that the chairs take up less room when they are not required. It will be appreciated that some situations or events will require thousands of folding chairs, all of which may need to be folded and stored at any given period. Thus, the chairs must be folded and stored such that they have a high storage density to minimize the storage space required. It will be appreciated that any extra thickness of a chair when folded becomes significant when numerous folding chairs are involved. For example, with a thousand stacked folding chairs, a folding chair which saves one extra inch in the folded position results in over 80 linear feet of saved storage space.

One disadvantage with many prior art folding chairs is the bulk or thickness of the chair in the folded position. Many typical folding chairs still remain several inches thick in the folded position, and thus are less dense when stored. For example, many typical folding chairs have seats which fold adjacent to or abutting the legs, and/or have front and back legs which fold against one another, such that the thickness of the chairs in the folded position comprises the thickness of both the front and rear legs, and/or the thickness of the legs and the seat. Another disadvantage of many conventional folding chairs is that they fold awkwardly, with bulky folded configurations and/or various protruding members.

In addition, it is desirable that the folding chairs be easily storable or stackable, and be stable when stored/stacked. Many typical prior art folding chairs are stored merely by leaning one chair against a wall and subsequent chairs in a series against the first chair. It will be appreciated that a plurality of folding chairs stacked against a wall have a potential domino effect, with all of the chairs subject to being knocked over. Other prior art folding chairs have complicated and expensive hanging rack systems. For example, a wheeled cart might have a plurality of support arms from which a plurality of folding chairs are suspended. One disadvantage of these types of systems is that chairs on the end of the hangers tend to fall off the rack, and the wheeled racks are difficult to move and maneuver.

Some types of prior art folding chairs have back rest portions which protrude from the chair and into an adjacent folding chair. For example, a folding chair may have a back portion which curves outwardly to protrude from the frame of the chair, and into the frame of and adjacent folding chair. Although this relationship allows the chairs to be stored with greater density, the chairs tend to be unstable in a stored position. The broad rounded backs of the chairs act as ramps which fail to resist movement of an adjacent chair. In addition, the chairs are still relatively thick and bulky.

It also is desirable that the chairs be easy to set up and take down, or fold and unfold. It will be appreciated that there is considerable time involved in setting up and taking down thousands of chairs. One disadvantage of many prior art folding chairs is that they are difficult to both unfold and fold. For example, most folding chairs require the person to use both hands to fold and unfold the chair. One hand usually has to grasp the back of the chair while the other hand has to grab and pivot the seat in or out.

It also is desirable that the chairs be comfortable. Typical prior art folding chairs have rigid metal seats and seat backs which can be hard and uncomfortable. One disadvantage of many prior art folding chairs is that the chairs either fold well and are uncomfortable, or are comfortable but are awkward in folding. Thus, there tends to be a trade off between comfort and foldability. Some chairs provide a cushion. But these chairs still utilize the rigid metal seat bottoms and seat backs, and the cushions tend to make the chairs even thicker when folded.

In addition, it is desirable that the chair provide proper support, or be ergonomically designed. One disadvantage of many prior art chairs is that the angle between the back rest and the seat is dictated by the folding mechanism of the chair. Thus, in an effort to create a folding chair, the proper ergonomic design of the back rest and seat is often compromised in order to obtain a chair that folds.

Another disadvantage of many typical prior art folding chairs is that they have a relatively small back support which may not adequately support a user's back. The small back support is often a function of the folding configuration of the chair. Again, the back support is often compromised in order to obtain a chair that folds. For example, the seat may be configured to fold upwardly or towards the back support, so that a relatively large space must exist between the back support and the seat so that the seat may fold into that space. That space is usually located where a user requires back support.

It also is desirable that the folding chair be durable. It will be appreciated that the chair will be alternately stored and used, folded and unfolded, innumerable times. Similarly, it is desirable that the folding chair be strong. The chair must be able to support persons of various weight, often in potentially abusive conditions.

It also is desirable that the folding chair be safe. It will be appreciated that as the various parts of the chair fold, there is a potential for fingers and the like to become pinched within the folding mechanisms.

Therefore, it would be advantageous to develop a folding chair capable of folding for high density storage. It also would be advantageous to develop such a folding chair which is more stable and safe in the folded and stored position. It would further be advantageous to develop a folding chair which (i) may easily be folded and unfolded; (ii) is comfortable and safe; (iii) is durable, strong, and cost effective.

OBJECTS AND SUMMARY OF THE INVENTION

It is therefore an object of the present invention to provide a folding chair which folds relatively thin to maximize storage density.

It is another object of the present invention to provide such a folding chair which stores safely and is stable when stored, and/or stacked.

It is another object of the present invention to provide a folding chair which is easily folded and unfolded.

It is yet another object of the present invention to provide a folding chair which is safe and comfortable.

It is yet another object of the present invention to provide a folding chair which is durable, strong, and cost effective.

The above objects and others not specifically recited are realized in a specific illustrative embodiment of a folding chair having a support frame with a back support portion and first and second side supports extending to form front leg members. A seat is pivotally coupled to the support frame, and configured to pivot downwardly with respect to the support frame to fold between the front leg members in a closed position.

First and second rear legs each including an upper member pivotally coupled to a lower member. The lower members are pivotally coupled to the support frame. The upper members are pivotally coupled to the seat and define linkage members. Thus, the rear legs include three pivot points and fold onto themselves to a shorter length in a closed position.

The support frame, the seat, and the first and second rear legs define respective first and second folding systems forming four-bar linkage systems. Each folding system has four pivot points and four linkages. The first linkages are defined by the first and second side supports of the support frame. The second linkages are defined by the lower members of the first and second rear legs. The third linkages are defined by the upper members of the first and second rear legs. Finally, the fourth linkages are defined by first and second sides of the seat. The four pivot points of the first and second folding systems advantageously fold substantially in-line. In addition, the folding systems fold onto themselves substantially within a volume defined by the support frame when the folding chair is in the closed folded position.

The folding systems advantageously include at least one stopper coupled to the four-bar linkage system, and shaped and positioned to engage at least one of the linkages when the folding chair is in the opened unfolded position to provide a limited opened position. In accordance with one aspect of the present invention, the stopper is formed on at least one of the upper members, and is shaped and positioned to engage at least one of the lower members of the first and second rear legs in the opened unfolded position. Preferably, the at least one stopper is formed on an extension from at least one of the upper members, and engages at least one of the lower members at a location substantially in line with the side supports such that the flanged stopper is shielded by the side support.

The support frame has first and second rigid side support members, each with an upper back support portion and extending forwardly to form front leg portions. The back support portion and the front leg portions are integrally and rigidly connected to advantageously form a curved spline profile.

A seat is pivotally coupled to the support frame, or to and between the first and second support members. A majority of the seat advantageously collapses to a folded position within a volume defined between the first and second rigid side support members.

Rear legs are pivotally coupled to the support frame, or to the respective first and second support members. A majority of the rear legs advantageously collapse to a folded position within the volume defined by the support frame between the first and second rigid support members.

In the folded position, the chair is relatively thin, and is substantially contained within the support frame and the curved spline profile. Thus, a plurality of chairs advantageously are able to be stacked together with a very high density. In addition, the chairs have a substantially curved spline profile in the folded position. The first and second support members, the seat and the rear legs have a curved spline profile of substantially uniform thickness in the closed folded position. The curved spline profile forms a protrusion and a recess such that a protrusion of a first folding chair may nest with a recess of a second folding chair. Thus, a plurality of chairs advantageously are able to nest together for greater stability.

In accordance with one aspect of the present invention, the support frame and first and second support members preferably are shaped to form a composite curve with an s-shape.

In accordance with another aspect of the present invention, the front leg portions and rear legs are curved. The rear legs advantageously have a radius of curvature smaller than a radius of curvature of the front leg portions. The smaller radius of curvature of the rear legs allows the rear legs to pivot substantially between the front leg portions in the closed folded position. In addition, a bottom portion of the rear legs advantageously extends beyond the volume defined by the rigid support frame when the chair is in a folded position. Thus, the bottom portion of the rear legs advantageously nests with the front leg portions of a second adjacent folding chair to resist lateral relative movement and increase stability of the stacked chairs.

In accordance with another aspect of the present invention, front and rear cross support members couple together the respective front leg portions and the rear legs. At least the front cross support member has left and right channels for substantially receiving a section of a rigid support frame of a second folding chair to increase stability, and to allow the rear legs to further collapse within the volume of the frame.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
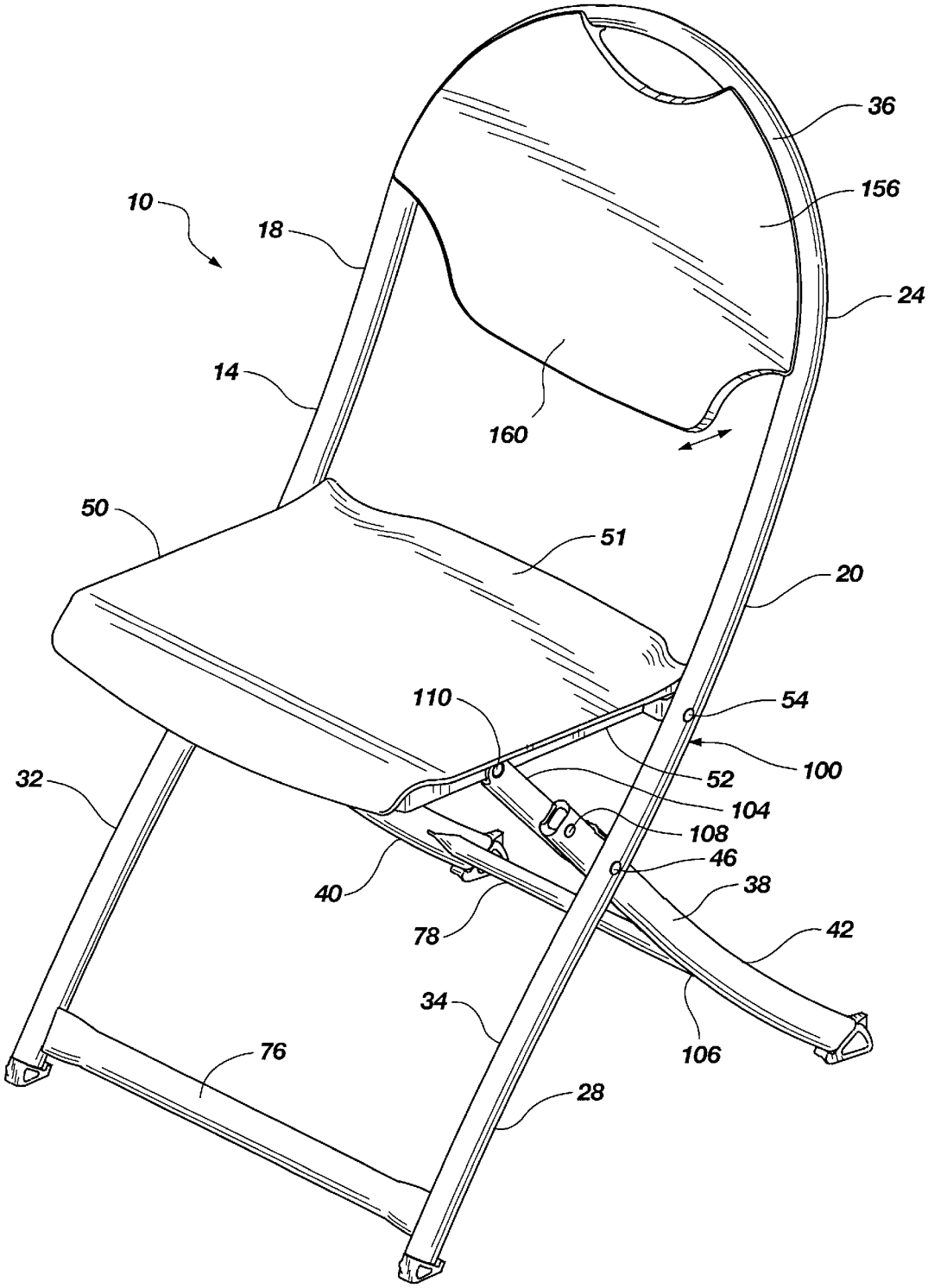
FIG. 1 is a perspective view of a preferred embodiment of a folding chair in accordance with the present invention in a first open unfolded position.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 3:
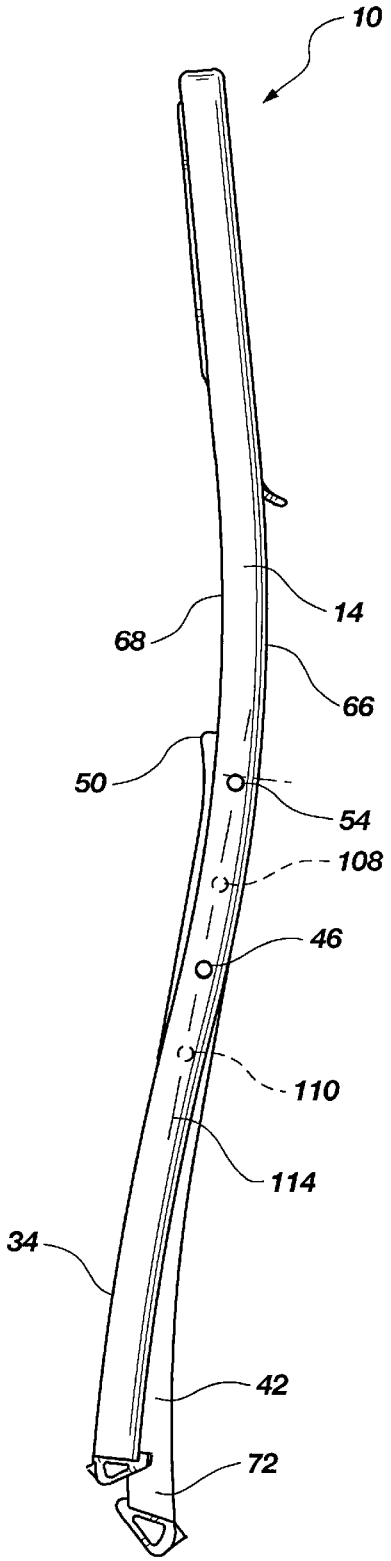
FIG. 3 is a side view of the preferred embodiment of the folding chair of the present invention in a second closed folded position.
Figure 4:
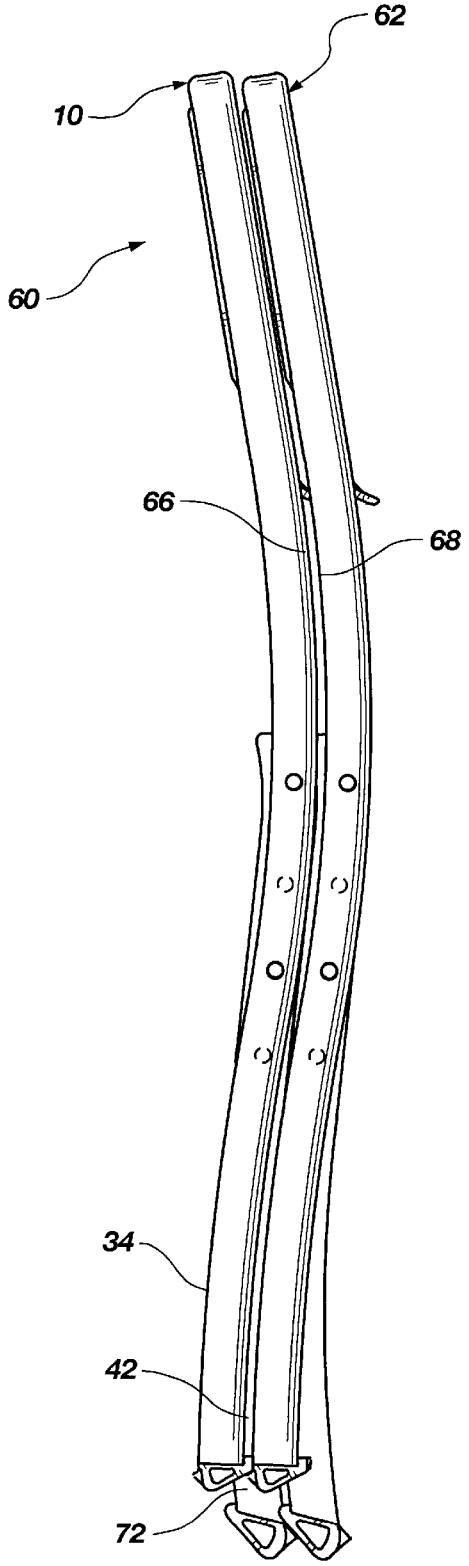
FIG. 4 is a side view of the preferred embodiment of a stale/stackable folding chair system of the present invention showing two folding chairs in the folded position which are disposed adjacent one another in a nesting or indexing relationship.

As illustrated in FIG. 1, a folding chair, indicated at 10, in accordance with the present invention, is shown in a first, open, unfolded orientation or position. As indicated above, typical prior art chairs fold into a thick, awkward or bulky shape or configuration, or have significant protruding members, such that typical prior art folding chairs are less dense when stored, and require more space for storage. The folding chair 10 of the present invention utilizes a new approach in which the chair 10 is designed or configured to fold or collapse into a minimum thickness, such that the chairs 10 of the present invention have a very high storage density, while still providing strength, comfort, and durability. Thus, when folded, the chair 10 of the present invention advantageously is thin or presents a minimal profile, as shown in FIG. 3. In addition, the thin profile of the chair 10 advantageously is shaped or configured to facilitate nesting or indexing with adjacent chairs, as shown in FIG. 4.

The shape of the thin profile of the chair of the present invention 10 may take various configurations, as described in co-pending U.S. patent application Ser. No. 09/425,586, filed Oct. 22, 1999 which is herein incorporated by reference.

Figure 2:
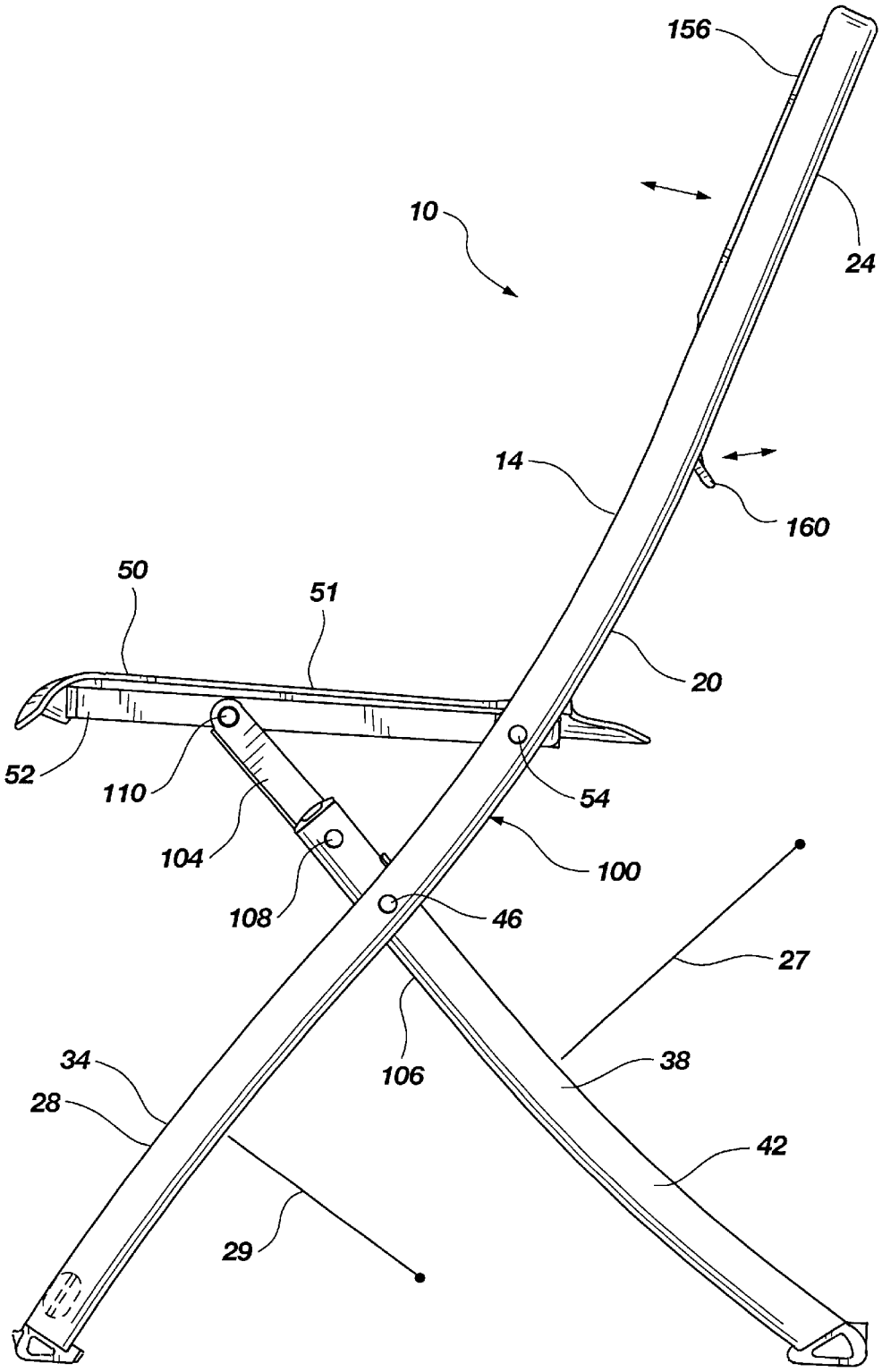
FIG. 2 is a side view of the preferred embodiment of the folding chair in accordance with the present invention in the first open unfolded position.

Referring to FIGS. 1 and 2, the folding chair 10 has a rigid support frame 14 including left and right, or first and second, rigid side supports 18 and 20, as shown in FIG. 1. As indicated above, it is desirable that the chair 10 be durable and strong. Thus, the rigid nature of the support frame 14 increases the durability and strength of the chair 10.

Preferably, the support frame 14 is formed from a tubular material to optimize strength and weight. In addition, the tubular material preferably has an elongated cross-sectional shape which is oriented generally vertically to increase the weight capacity of the chair 10. Furthermore, the tubular material preferably has rounded corners, or most preferably has an oval cross-sectional shape, giving soft edges to the frame 14 which are more comfortable.

The support frame 14, and side supports 18 and 20, have an upper back support portion 24 forming the back of the chair 10, and a lower front leg portion 28 formed integrally and continuously with the upper back support portion 24. The back support portion 24 extends forwardly from the back of the chair 10 to the lower front leg portions 28. Thus, the first and second side supports 18 and 20, or the upper and lower portions 24 and 28 thereof, are unitary, integral, and rigid structures to increase strength and durability. The front leg portion 28 preferably includes left and right, or first and second, front legs 32 and 34. In addition, the support frame 14, or side supports 18 and 20, may be a single integral member with a broad curved back member 36 formed at the tops of the side supports 18 and 20, as shown.

As indicated above, the rigid support frame 14 preferably is shaped to form a curved spline profile. As used herein, the term "curved spline" is used broadly to describe an elongated member with at least a curved portion, and which may include multiple curves and/or straight portions as well. The profile is an elongated continuous profile having a substantially uniform thickness which is relatively thin when all elements are collapsed within the profile. The thin uniform profile contributes to a higher storage density of the chairs.

The chair 10 also includes a rear leg portion 38, which preferably includes left and right, or first and second, rear legs 40 and 42, as shown in FIG. 1. The rear leg portion 38, or rear legs 40 and 42, are pivotally coupled to the support frame 14 at leg pivot points 46. The leg pivot points 46 are preferably fixed pivot points, such that the rear legs 40 and 42 pivot with respect to the support frame 14 or front legs 32 and 34.

In addition, the chair 10 includes a seat or seat portion 50 pivotally coupled to the support frame 14, and between the side supports 18 and 20 at seat pivot points 54. Again, the seat pivot points 54 are preferably fixed pivot points such that the seat 50 pivots with respect to the support frame 14, rather than sliding. The seat 50 and rear legs 40 and 42 also are pivotally connected as discussed in greater detail below.

The seat 50 may comprise a seating surface 51 secured to a seat frame 52. The seat frame 52 may extend generally around the perimeter of the seat 50, or along the sides, front and back of the seat 50. This provides an advantage where the seat may flex in response to a load, as discussed below. The seating surface 51 is disposed on the seat frame 52, and spans the distance between the perimeter of the frame 52. Preferably, the seating surface 51 is formed of a flexible material, and flexes, bends, or deflects downwardly and into the seat frame 52 in response to, and proportional to, a user's weight. The flexibility of the seating surface 51 is enabled because of the perimeter location of the seat frame 52, and allows the seating surface 51 to cup or curve, and thus conform to the user for a custom fit. In addition, the seating surface 51 preferably is coupled to the seat frame 52 only at the front and back, and not at the sides, to further allow the seat surface 51 to deflect.

The seat 50 and rear legs 40 and 42 pivot with respect to the support frame 14 between (i) the first, open, unfolded position, as shown in FIGS. 1 and 2, and (ii) the second, closed, folded position, as shown in FIG. 3. The leg pivot points 46 preferably are located on a straight section of the support frame 14, or first and second side supports 18 and 20, or at a mid-section of the composite curve. Thus, holes for the pivot points 46 may be formed in the side supports 18 and 20 prior to bending the support frame 14 during the manufacturing process. If the holes are located on curved portions of the support frame 14, then forming the holes prior to bending may cause the holes to be mis-shaped as the curve portion of the support frame is formed.

The location of leg pivot points 46 facilitates a chair having a curved spline. By locating the pivot points 46 at the mid-section of a composite curve, or at the intersection of two linear members, the relative shear and load stresses (combined stresses), as well as the strain, in the frame 14 are at a minimum. The stress is high at the leg pivot points 46 because the real legs 40 and 42 act as lever arms to concentrate the force.

Referring to FIG. 3, the seat 50 and rear legs 40 and 42 advantageously pivot such that a majority of the seat 50 and a majority of the rear legs 40 and 42 collapse within a volume defined by the support frame 14. Thus, in the folded position, the chair 10 substantially maintains the curved spline profile of the support frame 14. The chair 10 (or the support frame 14, seat 50 and rear legs 40 and 42) also advantageously has a curved spline profile in the closed position, with the profile having a substantially uniform thickness which is relatively thin. The volume defined by the support frame 14 is the space between the side supports 18 and 20. Thus, the seat 50 and rear legs 40 and 42 pivot such that a majority of the seat 50 and rear legs 40 and 42 fold directly between the side supports 18 and 20.

The seat 50 and rear legs 40 and 42 collapsing within the volume of the frame 14 provides a distinct advantage over prior art folding chairs, in which the seat and legs fold inwardly and onto the frame such that the frame, legs and seat each add a thickness dimension to form a relatively thick stack. In addition, the curved spline profile of the chair 10 in the folded position provides a distinct advantage over the prior art chairs, in which the profiles are straight and/or bulky. The chairs 10 of the present invention are capable of not only folding into a relatively thin profile in order to save storage space, but also forming a continuously and similarly shaped profile in which the profiles of adjacent chairs may be matched or nested to increase stability of the chairs in a stacked and stored relationship.

As illustrated in FIG. 4, a storable folding chair system, indicated generally at 60, may include a plurality of the above described chairs, including, for example, a first chair 10 and a second chair 62. The curved spline profile of the first folded chair 10 nests or indexes with the curved spline profile of the second folded chair 62 to resist relative motion of the two chairs 10 and 62 when disposed adjacent one another in an adjacent storage relationship. Referring again to FIG. 3, the curvature of the profile creates a protrusion or protruding portion 66 of the profile and an opposite matching indentation or recess 68 in the profile as the profile deviates from a straight line into a curvature. Thus, referring to FIG. 4, the protrusion 66 of the profile of the first chair 10 nests or indexes within the indentation or recess 68 of the profile of the second chair 62. Unlike many prior art folding chairs, which include a backrest portion which protrudes from the straight thick profile of the chair into the straight thick profile of an adjacent chair, the entire profile of the chair 10 of the present invention simultaneously forms the protrusions 66 and indentations 68 such that it is the entire profile of the chairs 10 and 62 which match to nest.

Referring again to FIGS. 1 and 2, the front legs 32 and 34 are preferably curved, and may be convex, as shown. The rear legs 40 and 42 are advantageously similarly curved so that the rear legs 40 and 42 may substantially collapse within the volume defined by the front legs 32 and 34. Both the front and rear legs 28 and 38 have a radius of curvature, with the radius of curvature 27 of the rear legs 40 and 42 being smaller than the radius of curvature 29 of the front legs 32 and 34. The smaller radius of curvature 27 of the rear legs 40 and 42 allows a greater portion of the rear legs 40 and 42 to collapse within the volume defined by the front legs 32 and 34.

Referring to FIG. 3, the smaller radius of curvature of the rear legs 40 and 42 also allows a portion of the bottom ends 72 of the rear legs 40 and 42 to protrude or extend outside the volume defined by the front legs 32 and 34. Although it is desirable to have a majority of the seat 50 and rear legs 40 and 42 collapse within the profile of the frame 14, the bottom ends 72 of the rear legs 40 and 42 extend outside of the volume of the front legs 32 and 34 to increase the stability of multiple stacked chairs. Referring to FIG. 4, it can be seen that the bottom ends 72 of the rear legs 42 of the first chair 10 protrude slightly from the profile, specifically of the front legs 34, of the first chair 10, and into the profile of the second chair 62. Therefore, the curved spline profile of the chairs 10 and 62 resists relative movement between the two chairs 10 and 62 in a longitudinal direction (or top to bottom direction), and the bottom end 72 of the first chair 10 protruding into the profile of the second chair 62 resists lateral relative motion (side-to-side) between the two chairs 10 and 62.

Referring again to FIG. 1, the chair 10 may further include front and rear cross support members 76 and 78. The front cross support member 76 is coupled to and between the front legs 32 and 34 near the bottoms thereof. Similarly, the rear cross support member 78 is coupled to and between the rear legs 40 and 42.

In addition, the chair 10 advantageously includes left and right, or first and second folding systems, represented by the second or right folding system 100, are formed by and pivotally couple the frame 14, seat 50 and respective first and second rear legs 40 and 42 together. The folding system 100 allows the various components of the chair 10 to fold as thinly as possible in the folded position, and provides strength to the seat in the open position.

The rear legs 40 and 42 are pivotally coupled to both the frame 14 and the seat 50. Referring again to FIGS. 1 and 2, the rear legs 40 and 42, and upper and lower members or portions 104 and 106, are pivotally coupled together at pivot point 108. The upper and lower portions 104 and 106 of the rear legs 40 and 42 preferably are coupled in a side by side relationship. The pivotal coupling 108 between the upper and lower members 104 and 106 of the rear legs 40 and 42 allows the upper and lower portions 104 and 106 to pivot with respect to one another, and to fold onto themselves to a shorter length in the closed, folded position. The lower member 106 of the rear legs 40 and 42 is pivotally coupled to the support frame 14 at the leg pivot points 46. The upper members 104 of the rear legs 40 and 42 are pivotally coupled to the seat 50 at pivot point 110. Thus, the rear legs 40 and 42 include three pivot points 46, 108 and 110.

The folding systems 100 form four bar linkage systems with four pivot points and four linkages. A first linkage is formed by the support frame 14 or side support members 18 and 20. A second link is formed by the lower members 106 of the rear legs 40 and 42. A third linkage is formed by the upper members 104 of the rear legs 40 and 42. The upper member 104 forms a linkage member between the seat and lower member 106 of the legs 40 and 42. Finally, a fourth linkage is formed by the seat 50 or seat frame 52. Thus, the four bar linkage system includes four links 20, 51, 104 and 106, and four pivot points, 46, 54, 108 and 110.

Figure 5:
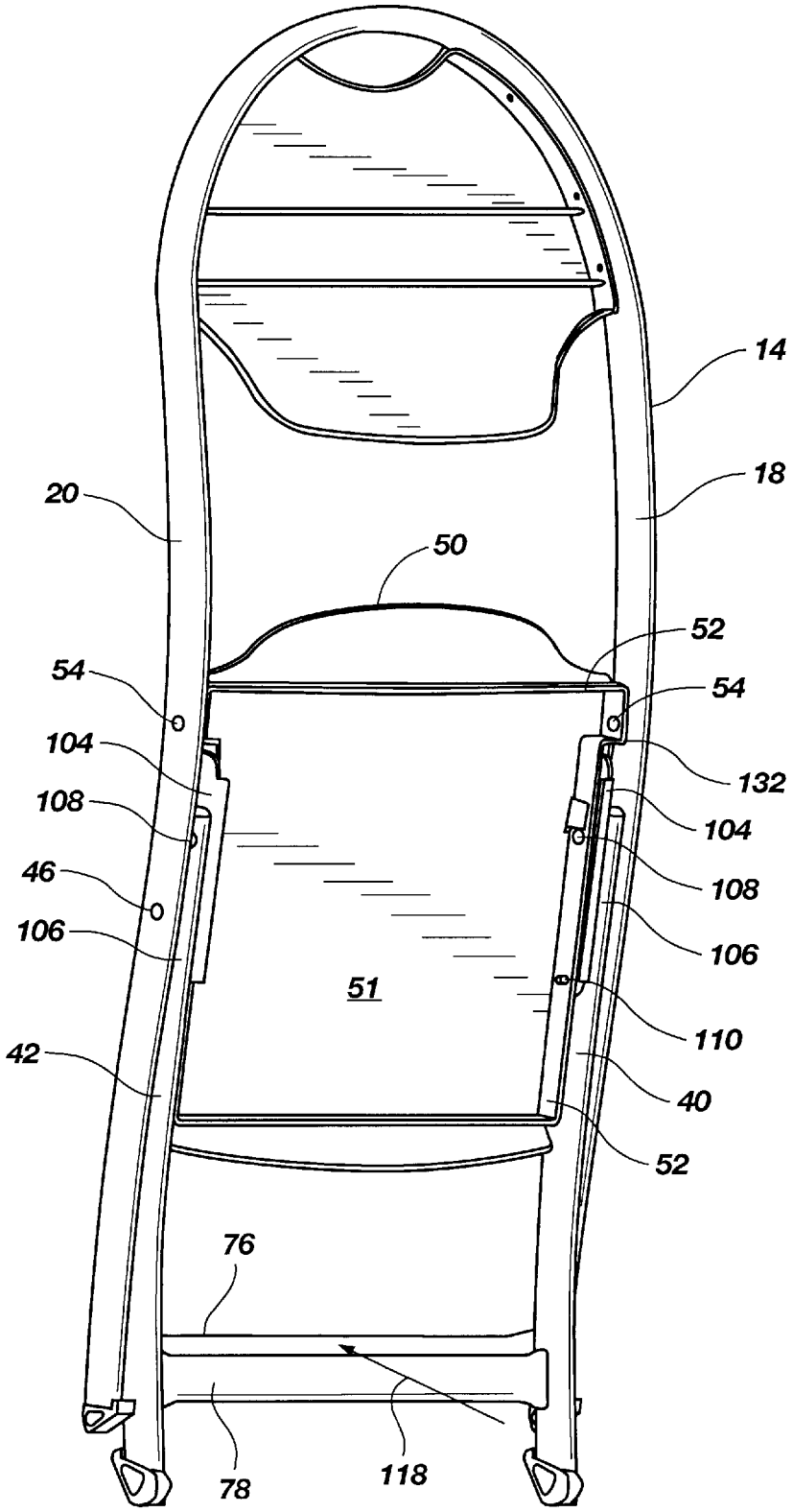
FIG. 5 is a perspective view of the preferred embodiment of the folding chair in accordance with the present invention shown in the closed, folded position.

Referring to FIGS. 1 and 5, the side support members 18 and 20, or first linkage, preferably form the outside perimeter or outermost sides of the chair 10. The lower members 106 of the rear legs 40 and 42, or the second linkage, are disposed inside the side supports 18 and 20. The upper members 104 of the rear legs 40 and 42, or third linkage, are disposed inside the lower members 106. The seat 50 or seat frame 52, or fourth linkage, is disposed inside the upper members 104, and inside the side support members 18 and 20.

Therefore, as illustrated in FIG. 5, the four-bar linkage system may fold upon itself, and collapse into a volume of the support frame 14. In addition, the folding systems 100 fold substantially in line, as indicated by line 114 in FIG. 3. Thus, all the linkages of the four bar linkage system, or the side support members 18 and 20, rear legs 40 and 42, and seat 50, fold substantially onto themselves, and substantially in line. Therefore, the configuration of the linkage systems 100 as four bar linkage systems allows the chair to fold into the thin profile in the folded position. In addition, pivotally coupling all linkages, including the rear legs, provides greater stability.

When the chair 10 is in an open, unfolded position, as illustrated in FIGS. 1 and 2, the folding systems, or four bar linkage systems, are also in an open orientation. In the open orientation, the four bar linkage system forms an inverted triangular shape. When the chair is in the closed, folded, position as illustrated in FIGS. 3 and 5, the folding system 100 or four bar linkage system is also in a closed orientation. The inverted triangular configuration of the four bar linkage system provides greater stability. It is desirable to maximize the size of the inverted triangle to maximize the stability. For example, it is desirable to place the pivot point 110 of the rear legs 40 and 42 or upper members 104 and the seat 50 as forwardly as possible to increase stability and facilitate the tendency for the chair to open to a stable, locked position.

The stability of the chair 10 in the open position is a function of the pivot axis 110 because any weight put on the chair or seat 50 behind the forward most pivot point 110 pushes the chair into an open, locked and stable position. Although it is desirable to place the pivot point 110 as forwardly as possible in the seat 50, doing so decreases the angle between the rear legs 40 and 42 and the floor, thus decreasing the size of the inverted triangle, or causing the lower portion 72 of the rear legs 40 and 42 to extend further outward, thus causing a tripping hazard. Thus, it is important to balance several factors, including maintaining as large an angle in the rear legs 40 and 42 as possible for strength, without having the rear legs protrude too far, and maintaining a forward pivot point 110 as forwardly as possible for stability. The chair 10 also has a footprint defined by the width of the chair, and the location on the floor of the front and rear legs 32 and 34 and 40 and 42. It is of course desirable to have as large a footprint as possible for stability; however, it is also important to prevent the legs from sticking out too far and becoming a tripping hazard.

In the closed, folded orientation, as illustrated in FIG. 5, the folding systems 100, or four bar linkage systems, fold substantially onto themselves and substantially in line, and all of the pivot points 46, 54, 108 and 110 are substantially in line or lay substantially in a straight line. Because the pivot points 46, 54, 108 and 110 are in line in the folded position, the chair 10 is stable in the folded position and resists inadvertent unfolding, or will not unfold without assistance.

Figure 6:
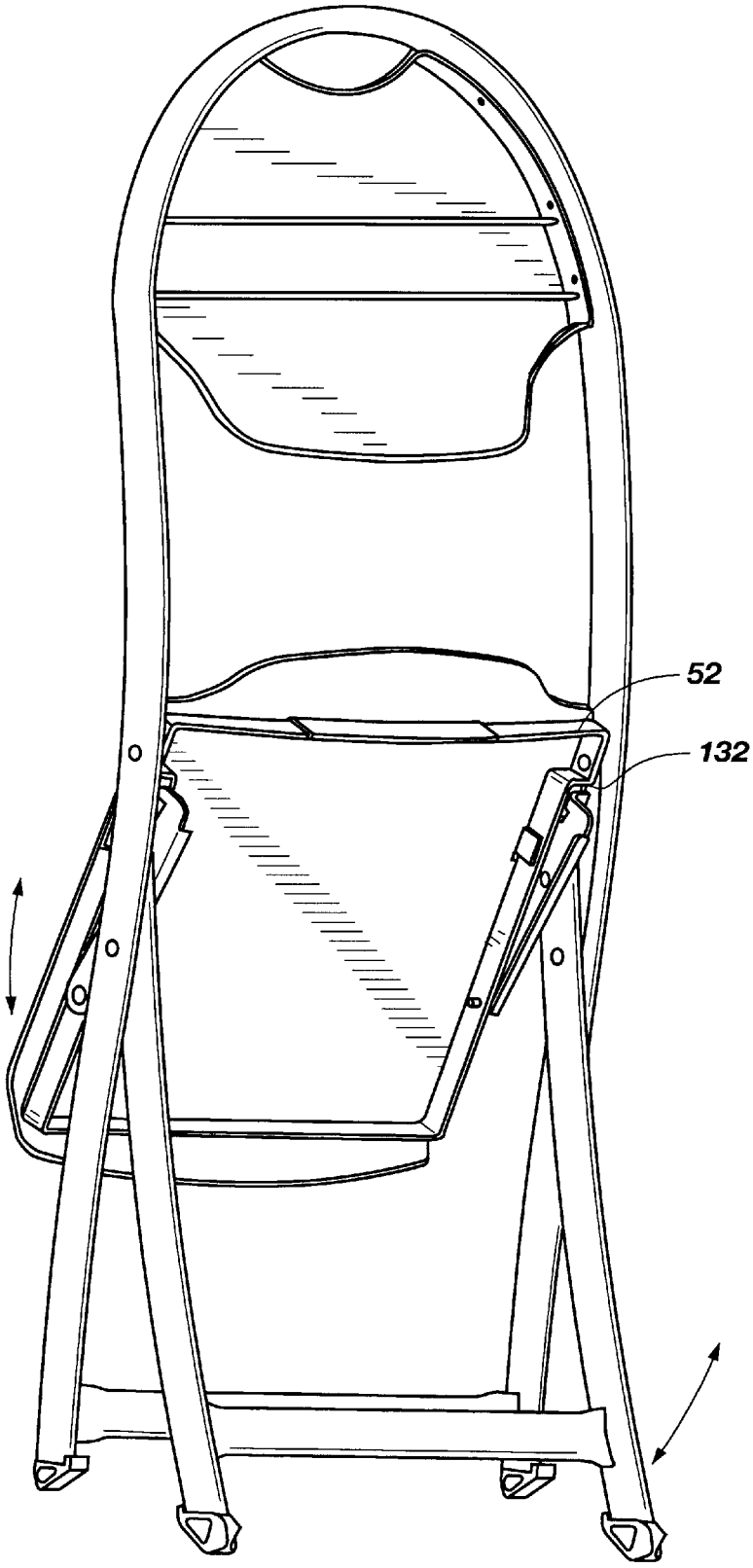
FIG. 6 is a perspective view of the preferred embodiment of the folding chair in accordance with the present invention shown in an intermediate position.
Figure 7:
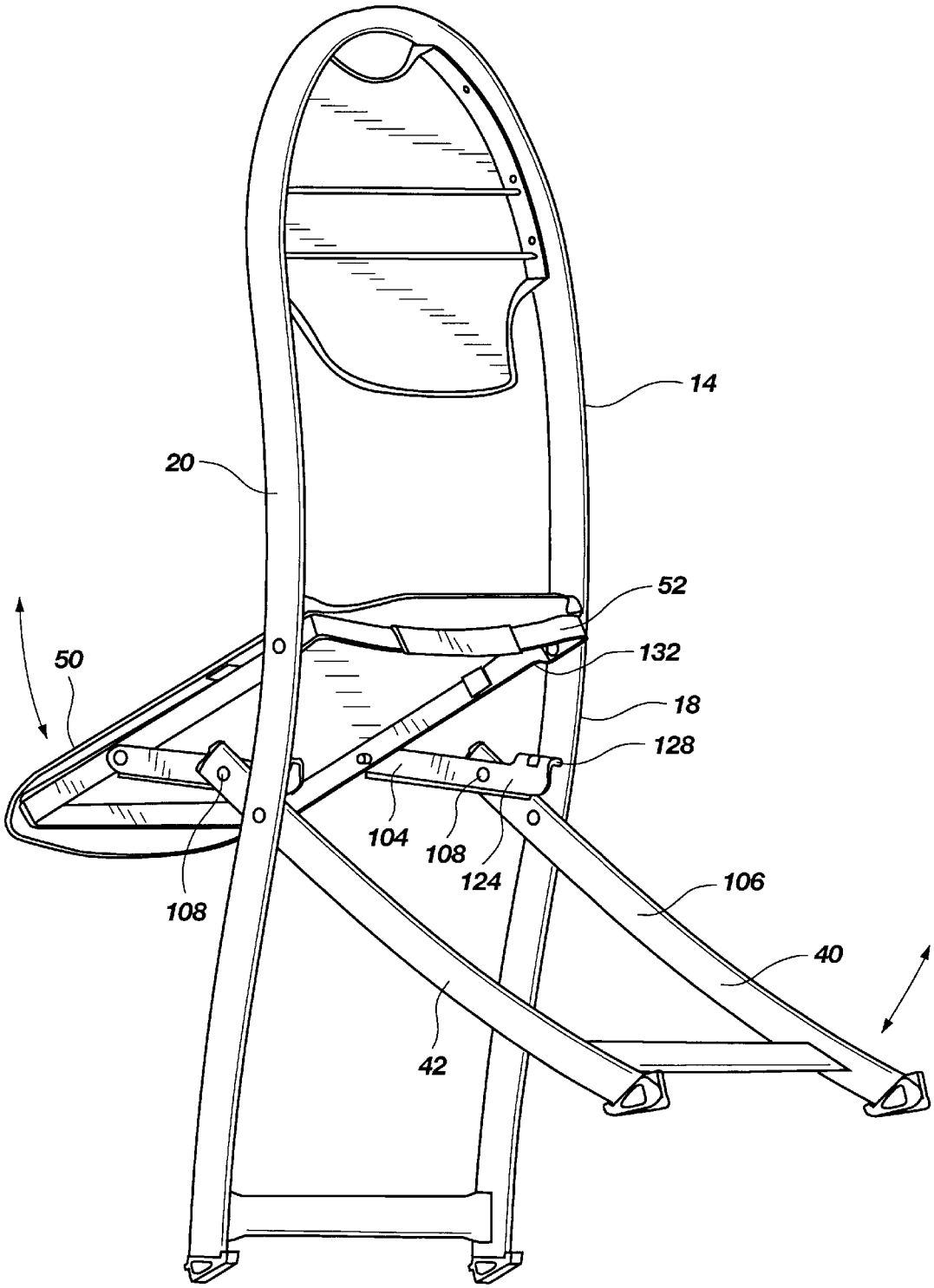
FIG. 7 is a perspective view of the preferred embodiment of the folding chair in accordance with the present invention shown in an intermidiate position.

Referring to FIGS. 5–7, the chair 10 of the present invention is shown transitioning from the closed, folded position to a partially open position, or from a partially open position to the closed, folded position. The figures also illustrate the folding system 100, or four bar linkage systems, folding upon themselves and becoming substantially in-line. To open the chair, or transition the chair from the closed, folded position to the open, unfolded position, force is applied to the front legs 32 and 34, through front cross support member 76, as indicated by arrow 118. Alternatively, the force could be applied to the back of the seat 50. The applied force 118 causes the seat 50 to pivot away from the support frame 14 which causes the rear legs 40 and 42 also to pivot outwardly away from the frame 14. Thus, the applied force 118 causes the folding system 100, or four bar linkage systems to move from their stable folded positions to a more open position. Once the folding systems 100, or four bar linkage systems, have been moved out of the stable, folded position, any additional force, such as a user sitting on the seat, or setting the chair 10 on the ground, tends to cause the folding system 100, or four bar linkage systems, to be forced into the fully open position. Therefore, the chairs 10 tend to be safer because any additional force tends to open the chair rather than fold the chair.

To open the chair, a person may set the chair on the ground with the bottom of the rear legs 72 contacting the ground while holding the top of the chair and applying the force 118 onto the front legs 32 and 34, such as by pushing on the front cross support member 76 with the person's foot. Alternatively, the chair may be opened by swinging the chair in a forward direction and impacting the bottom portion 72 of the rear legs on the ground, such that the momentum of the swinging chair causes the seat 50 and front legs 32 and 34 to continue in a forward motion, thus opening the chair. Therefore, the chairs 10 may be opened with one hand.

In addition, the folding system 100 advantageously includes a stop or stopping member to limit movement of the folding system in the open position to prevent further movement. For example, the stop or stopping member may be attached to one of the links of the four bar linkage systems, and positioned to abut another one of the links in the open position to limit movement of the four bar linkage system at that point.

Figure 8:
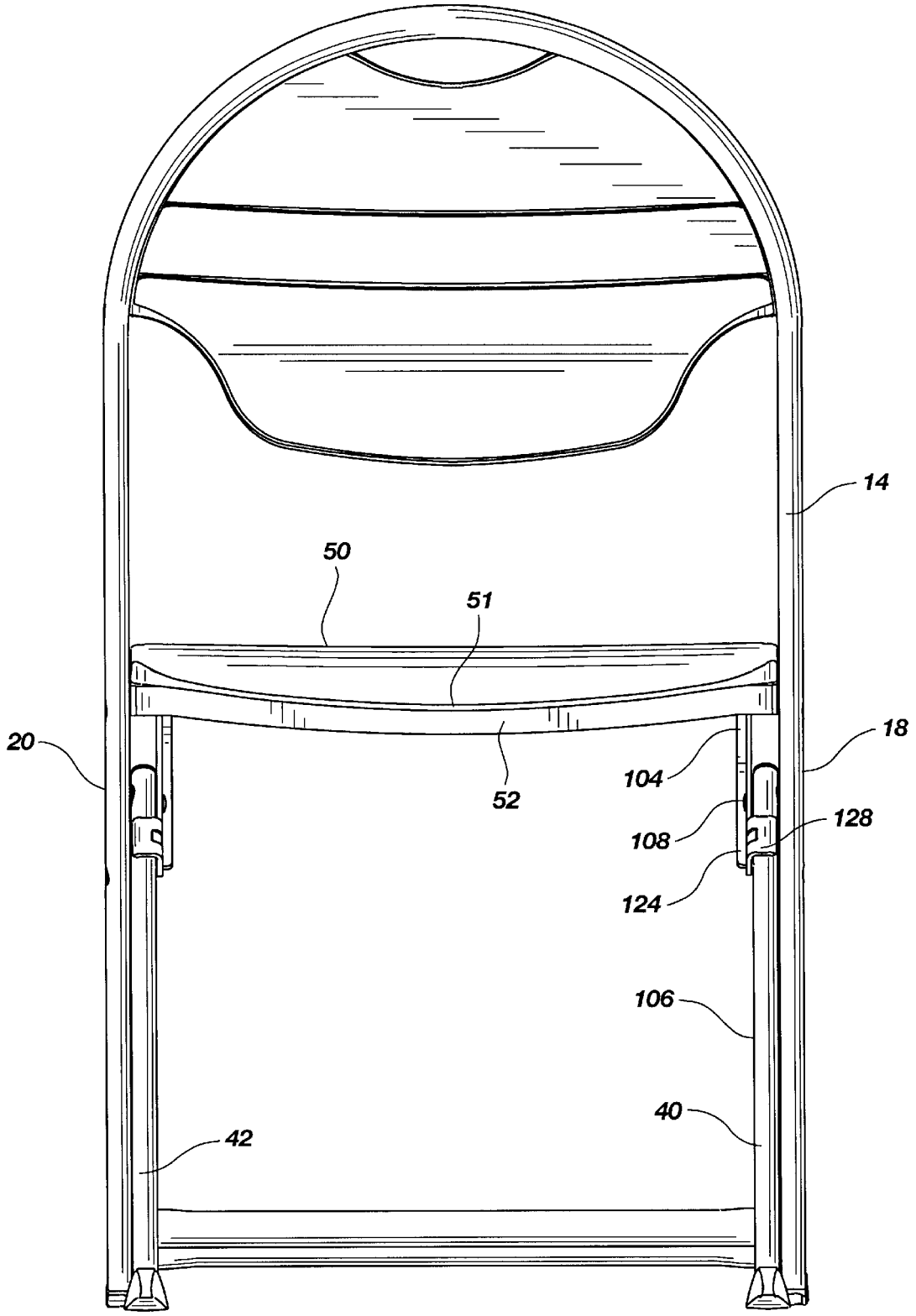
FIG. 8 is a rear view of the preferred embodiment of the folding chair in accordance with the present invention.

Referring to FIGS. 7 and 8, the upper portion or member 104 of a the rear legs 40 and 42 has an extension 124 which extends beyond the pivot point 108 between the upper and lower members 104 and 106 of the rear legs 40 and 42, such that the extension 124 extends along or towards the lower member 106 of the rear legs 40 and 42. The extension 124 extends linearly from the upper member 104 such that the extension 124 extends alongside the lower member 106 in the open position. The stopper is preferably a flange 128 formed on the extension 124 of the upper portion 104 of the rear legs 40 and 42. Thus, as the four bar linkage systems unfold into the open, unfolded position, the upper and lower members 104 and 106 of the rear legs 40 and 42 align, and the flange 128 of the extension 124 abuts the lower portions 106 of the rear legs 40 and 42, limiting further movement.

The extension 124 of the upper member 104 of the rear legs 40 and 42 advantageously is sized to extend alongside the support frame 14 or alongside the side supports 18 and 20 in either or both of the open and closed positions. Therefore, the frame 14 or side supports 18 and 20 act as a shield to shield the stopper or flange 128, substantially impeding unintentional insertion of a hand or finger or the like between the flange 128 and the lower member 106 of the rear legs 40 and 42, to prevent a person from being inadvertently pinched by the flange 128.

It is of course understood that a stopper may be formed on any of the links and shaped or configured to abut any of the other links.

To fold the chair, or transition the chair from the open, unfolded position to the closed, folded position, a user may place his or her foot on the rear cross support member 78 and pull upwardly on the support frame 14, causing the chair to move into the closed, folded position. Alternatively, the user may lift the chair and swing it rearwardly, and impact the lower portion 72 of the rear legs 40 and 42 on the ground, such that the momentum of the swinging chair 50 causes the seat 50 and front legs 32 and 34 to continue to move rearwardly into the folded position. Therefore, the chairs 10 may also be closed using one hand.

Referring to FIGS. 5–7, the seat frame 52 has a notched corner 132, or a notch formed in the back corners of the seat, for receiving the flange 128 therein when the chair is in the closed, folded position. Because the folding systems, or four bar linkage systems, substantially fold onto themselves, the upper portions 104 of the rear legs 40 and 42 fold adjacent the seat frame 52 in the closed position. The notched corner 132 allows room for the flange 128 and allows the upper members 104 of the rear legs 40 and 42 to fold adjacent and in-line with the seat frame 52.

In addition, the folding chair 10 includes a flexible back support 156 coupled to the upper back support portion 24 of the support frame 14, and a lower lumbar region or member 160.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A folding chair comprising:

a support frame having a back support portion and first and second side supports extending to form a pair of front leg members;

a seat, pivotally coupled to the support frame, and configured to pivot downwardly with respect to the support frame and folding between the front leg members in a closed position; and first and second rear legs each including an upper link and a lower member pivotally coupled together, the lower members being pivotally coupled directly to the support frame, and the upper links being pivotally coupled directly to the seat, such that the first and second rear legs include three pivot points and the rear legs each fold onto themselves to a shorter length in a closed position.

2. The folding chair of claim 1, wherein the support frame, the seat, and the first and second rear legs define respective first and second folding systems forming four-bar linkage systems each having four pivot points and four linkages for folding the chair between an open unfolded position and a closed folded position.

3. The folding chair of claim 2, wherein the four-bar linkage systems form inverted triangular support structures when the folding chair is in the open position.

4. The folding chair of claim 2, wherein first linkages of the four-bar linkage systems are defined by the first and second side supports of the support frame; second linkages of the four-bar linkage system are defined by the lower members of the first and second rear legs; third linkages of the four-bar linkage system are defined by the upper members of the first and second rear legs; and fourth linkages of the four-bar linkage system are defined by first and second sides of the seat.

5. The folding chair of claim 2, wherein the stopping member is formed on at least one of the upper members and positioned to engage at least one of the lower members of the first and second rear legs in the open unfolded position.

6. The folding chair of claim 2, wherein the four pivot points of the first and second folding systems fold substantially in-line, and wherein the first and second folding systems fold onto themselves substantially within a volume defined by the support frame when the folding chair is in the closed folded position.

7. The folding chair of claim 2, wherein first linkages of the four-bar linkage systems are defined by the first and second side supports of the support frame; second linkages of the four-bar linkage system are defined by the lower members of the first and second rear legs; third linkages of the four-bar linkage system are defined by the upper links of the first and second rear legs; and fourth linkages of the four-bar linkage system are defined by first and second sides of the seat.

8. The folding chair of claim 2, wherein the four-bar linkage system includes at least one flanged stopper coupled to the four-bar linkage system and shaped and positioned to engage at least one of the lower members of the first and second rear legs when the folding chair is in the open unfolded position to provide a limited open position.

9. The folding chair of claim 1, wherein at least one of the upper links includes a flanged stopper shaped and positioned to engage at least one of the lower members of the first and second rear legs in an open unfolded position.

10. The folding chair of claim 9, wherein the at least one flanged stopper is formed on an extension from at least one of the upper links and engages at least one of the lower members at a location substantially in line with the side supports such that the flanged stopper is shielded by the side support.

11. The folding chair of claim 9, wherein the seat further comprises a seat frame and a seating surface, the seat frame also having at least one notched corner for receiving the at least one flanged stopper when the folding chair is in the closed folded position.

12. The folding chair of claim 1, wherein the rear legs fold substantially within the support frame when the folding chair is in the closed folded position.

13. The folding chair of claim 1, wherein the upper links fold substantially towards a rear portion of the seat.

14. The folding chair of claim 1, wherein the three pivot points fold substantially into a straight line in the folded position.

15. A folding chair comprising:

a support frame having a back support portion and first and second side supports extending to form first and second front legs;

first and second rear legs, pivotally coupled to the support frame, each having upper and lower members pivotally coupled together;

a seat pivotally coupled to the support frame;

first and second folding systems linking the support frame, the seat, and the rear legs together, the first and second folding systems including a four-bar linkage system with four pivot points and four linkages; and at least one stopping member, formed on an extension from at least one of the upper members, such that the upper and lower members abut one another in an open unfolded position to provide a limited opened position, and such that the at least one stopping member engages at least one of the lower members at a location substantially in line with the side supports such that the stopper member is shielded by the side support.

16. The folding chair of claim 15, wherein the four pivot points of the first and second folding systems fold substantially in-line, and wherein the first and second folding systems fold onto themselves substantially within a volume defined by the support frame when the folding chair is in the closed folded position.

17. The folding chair of claim 15, wherein the seat further comprises a seat frame and a seating surface, the seat frame also having at least one notched corner for receiving the at least one stopping member when the folding chair is in the closed folded position.

18. The folding chair of claim 15, wherein the rear legs fold substantially within the support frame when the folding chair is in the closed folded position.

19. The folding chair of claim 15, wherein the four-bar linkage systems form inverted triangular support structures when the folding chair is in the open unfolded position.

20. The folding chair of claim 15, wherein the rear legs fold substantially within the support frame when the folding chair is in the folded position.

21. The folding chair of claim 15, wherein the four-bar linkage system forms an inverted triangular support structure when the folding chair is in the unfolded position.

22. A folding chair comprising:

a support frame having a back support portion and first and second side supports extending to form first and second front legs;

a seat pivotally coupled to the support frame;

first and second rear legs pivotally coupled to the support frame;

left and right linking members pivotally coupled to the seat and the first and second rear legs respectively, wherein the seat, the support frame, the first and second rear legs, and the left and right linking members each define a four-bar linkage system on both the left and right sides of the seat, having four pivot points and four links, which pivots as the folding chair moves between a folded position and an unfolded position, and which folds substantially in-line in the folded position, the four-bar linkage systems folding substantially along an axis and within a space defined between the first and second front legs in the folded position; and at least one stopper attached to and protruding from one of the links shaped to engage another one of the links in the unfolded position to prevent further pivoting of the four-bar linkage system and thus the folding chair.

23. The folding chair of claim 22, wherein the at least one stopper is an extension of either of the left and right linking members.

24. The folding chair of claim 22, wherein the at least one stopper is a flange extending from one of the linking members.

25. The folding chair of claim 22, wherein the at least one stopper is formed on an extension from at least one of the linking members and engages at least one of the rear legs at a location substantially in line with the side supports such that the stopper is shielded by the side support and substantially inaccessible to the hand or fingers of a user during operation and unfolding of the chair.

26. The folding chair of claim 22, wherein the four pivot points of the four-bar linkage system fold substantially in-line.

27. The folding chair of claim 22, wherein the space is defined between the first and second front legs and front and rear surfaces of the first and second front legs.

* * * * *